US009885009B2

(12) United States Patent
Brundel et al.

(10) Patent No.: US 9,885,009 B2
(45) Date of Patent: Feb. 6, 2018

(54) FABRIC CONDITIONERS COMPRISING ENCAPSULATED ACTIVE MATERIAL

(71) Applicant: Conopco, Inc., Englewood Cliffs, NJ (US)

(72) Inventors: Elizabeth Geertruida Maria Brundel, Nijkerk (NL); Gaëlle Jacobsen, Jersey City, NJ (US); Stephanus Cornelis Maria Otte, Heemstede (NL); Henricus Gerardus Maria Reijmer, Hoevelaken (NL); Samantha Small, Cheshire (GB); Volkert Willem Alexander de Villeneuve, Voorburg (NL)

(73) Assignee: CONOPCO, INC., Englewood Cliffs, NJ (US)

( * ) Notice: Subject to any disclaimer, the term of this patent is extended or adjusted under 35 U.S.C. 154(b) by 63 days.

(21) Appl. No.: 14/908,362

(22) PCT Filed: Nov. 3, 2014

(86) PCT No.: PCT/EP2014/073558

§ 371 (c)(1),
(2) Date: Jan. 28, 2016

(87) PCT Pub. No.: WO2015/067557

PCT Pub. Date: May 14, 2015

(65) Prior Publication Data

US 2016/0177241 A1 Jun. 23, 2016

(30) Foreign Application Priority Data

Nov. 11, 2013 (EP) ..... 13192336

(51) Int. Cl.

| | |
|---|---|
| ***C11D 3/50*** | (2006.01) |
| ***C11D 3/00*** | (2006.01) |
| ***C11D 17/00*** | (2006.01) |
| ***C11D 3/30*** | (2006.01) |

(52) U.S. Cl.

CPC ..... *C11D 3/505* (2013.01); *C11D 3/001* (2013.01); *C11D 3/30* (2013.01); *C11D 17/0039* (2013.01)

(58) Field of Classification Search

CPC ..... C11D 3/505

USPC ..... 512/4

See application file for complete search history.

(56) References Cited

U.S. PATENT DOCUMENTS

| | | | | |
|---|---|---|---|---|
| 2008/0305982 | A1 | 12/2008 | Smets et al. | |
| 2011/0269657 | A1 | 11/2011 | Dihora et al. | |
| 2012/0093899 | A1* | 4/2012 | Popplewell | B01J 13/02 424/401 |
| 2012/0192361 | A1* | 8/2012 | Janszen | C11D 1/62 8/137 |
| 2013/0039962 | A1 | 2/2013 | Smets et al. | |

FOREIGN PATENT DOCUMENTS

| | | |
|---|---|---|
| EP | 0385535 | 9/1990 |
| EP | 1533364 | 5/2005 |
| EP | 1767185 | 3/2007 |
| EP | 1797946 | 6/2007 |
| EP | 2087089 | 8/2009 |
| EP | 2094828 | 9/2009 |
| WO | WO2008066773 | 6/2008 |
| WO | WO2011075556 | 6/2011 |
| WO | WO2011094681 | 8/2011 |
| WO | W02015070228 | 5/2015 |

OTHER PUBLICATIONS

Search Report & Written Opinion in EP13192336, dated Apr. 14, 2014.

Search Report & Written Opinion in PCTEP2014073558, dated Jan. 16, 2015.

Notice of Opposition in EP14793103 (EP3068858) (P&G), Nov. 30, 2017.

Perfume capsule making protocol, Technical Report LAS02603EP-OX01, 2017, pp. 1-2; referred to as D9 in Opp.

* cited by examiner

*Primary Examiner* — Lanee Reuther

(74) *Attorney, Agent, or Firm* — Foley & Lardner LLP

(57) ABSTRACT

A fabric conditioning composition comprising: (a) at least 8 wt % of a fabric conditioning active; (b) a first capsule containing an active material, wherein the first capsule comprises a cured polymeric wall and a core; and (c) a second capsule containing an active material wherein the second capsule comprises a cured polymeric wall and a core; wherein the first and second capsules differ in properties due to their polymer walls having been made using the same polymer and different cure temperatures, curing times, or a combination thereof.

14 Claims, No Drawings

FABRIC CONDITIONERS COMPRISING ENCAPSULATED ACTIVE MATERIAL

TECHNICAL FIELD

The present invention relates to fabric conditioners comprising encapsulated active material to deliver benefit to consumers at different stages in a laundry process.

BACKGROUND AND PRIOR ART

Consumers desire stronger, long lasting fragrance from their laundered items. However, consumers also dislike overly strong perfume smell. The problem is how to control the delivery of perfume over multiple wash stages such that the perfume is not too weak or too strong.

Consumers evaluate perfume intensity at numerous stages of a laundry process, beginning with the moment the bottle is opened through to wearing the laundered clothes. Intermediate stages include when wet laundry is removed from the washing machine, whilst the washed items are drying in the air, during ironing and whilst the dry items are in storage. Also of increasing importance to consumers is the so-called perfume bloom, which is fragrance in a room arising from laundered items, which are drying.

Free (i.e. non-encapsulated) perfume oil provides an initial flush of fragrance that quickly dissipates. Whilst this is useful from the bottle, it is too weak during wearing of the laundered items. Much of the free perfume in laundry formulations is washed away with the wash water; free perfume cannot, therefore, satisfactorily deliver specific perfume notes at the different key stages.

In recent years, delivery of specific perfume notes at different key stages has been achieved by the use of encapsulated perfumes. Encapsulated technologies are known for use in laundry products. Such technologies provide enhanced fragrance delivery over conventional free perfume oil by overcoming the issue of perfume loss during the drying process by protecting the perfume in the capsule. Encapsulation also ensures that perfume is released at the optimal time to enable the provision of a perceivable benefit to the wearer of laundered garments. Examples of the mode of action of encapsulates include: shear sensitive action, where the perfume core is released in response to mechanical rupture of the encapsulate, and diffusive action, wherein perfume is released by diffusion through the outer wall of the encapsulate. Some encaps are capable of both release mechanisms. One type of capsule that has been used in laundry compositions has a melamine formaldehyde shell and a perfume core. Release of perfume from melamine formaldehyde capsules is friction based, the benefit becoming apparent after a rubbing process is applied to the treated fabric. This benefit is provided by a boost in perfume intensity during wear.

However, consumers desire a perfume release profile across multiple stages, not just one particular stage. We have determined that a linear release profile across the whole of the laundry process is a strong consumer want.

EP2087089 (P&G) and EP2094828 (Appleton Papers) disclose compositions comprising one or more core/shell particles having a volume weighted fracture strength of from 0.8 to 1.8 MPa. WO2008/066773 (P&G) and WO2008/063635 (Appleton Papers) disclose compositions comprising one or more core/shell particles, selected from the group consisting of Type 1 particles, Type 2 particles, Type 3 particles, Type 4 particles and mixtures thereof, which are defined by fracture strengths ranging from 0.5 to 16 MPa.

WO 2011/075556 (P&G) discloses fabric softeners containing a) a mixture of cross-linked melamine formaldehyde encapsulates and b) a material adjunct, which may be a fabric softener.

WO 2011/094681 (P&G) discloses fabric softening compositions comprising:

(a) a fabric softening active; (b) a first microcapsule encapsulating a first perfume, comprising 76% to 96% of perfume ingredients having a b.p. greater than 250° C. and a Log P greater than 2. 5; (c) a second microcapsule encapsulating a second perfume, which comprises 43% to 63% of perfume ingredients having a b.p. greater than 250° C. and a Log P greater than 2. 5; (d) wherein the weight ratio of the first to the second encapsulates is 50:50 to 70:30; and an optional free perfume, which is different from the first and second perfumes.

We have now found that the inclusion of a mixture of encaps having different release profiles significantly increases the perfume perception during multiple stages of a laundry process.

DEFINITION OF THE INVENTION

According to the present invention there is provided a fabric conditioning composition comprising:

(a) at least 8 wt % of a fabric conditioning active;

(b) a first capsule containing an active material, wherein the first capsule comprises a cured polymeric wall and a core; and (c) a second capsule containing an active material wherein the second capsule comprises a cured polymeric wall and a core;

wherein the first and second capsules differ in properties due to their polymer walls having been made using the same polymer and different cure temperatures, curing times, or a combination thereof.

Also according to the present invention there is provided a method for treating fabric comprising contacting the fabric with an aqueous dispersion comprising the composition.

DETAILED DESCRIPTION OF THE INVENTION

The Capsules

The mixture of capsules is composed of a first capsule containing an active material and a second capsule containing an active material (e.g., at a 1:1 ratio), wherein the first and second capsules differ in that their wall materials comprise the same type of polymer but are different in properties due to differing cure temperatures, curing times or a combination thereof. In some embodiments, the active materials of the first and second capsules are the same. In other embodiments, the active materials of the first and second capsules are different. In yet other embodiments, the active material of at least the first or second capsule is a fragrance. In certain embodiments, the first capsule is cured at a temperature above 120° C. and the second capsule is cured at a temperature above 80° C. In other embodiments the first and/or second capsule is cured for 1 to 4 hours. In yet other embodiments, the first and second capsules are stable when added to a fabric conditioner base for more than four weeks or more than eight weeks when stored at 37° C. and have release profiles that do not substantially change after 4 weeks or 8 weeks in storage.

The capsules (also referred to herein as "microcapsules") for use in the compositions of the present invention comprise a wall (also referred to herein as a "shell") and a core.

The wall comprises polymeric material, and is described in detail hereinbelow. Preferably, the wall is capable of being broken by application of shear force such as rubbing.

Capsules are conventionally cured at temperatures in the range of 50-85° C. Due to the nature of the wall polymers used to encapsulate the active materials and the volatile nature of many active materials, such as fragrance components, which would be compromised under increased curing temperatures, it would not be expected that increasing the curing temperature would provide capsules with improved retention capabilities. However, a crosslinked network of polymers containing active materials cured at high temperatures and for periods of time greater than one hour can provide a microcapsule product capable of retaining a much wider range of active materials during storage in consumer product bases that contain surfactants, alcohols, volatile silicones and mixtures thereof than previously possible. For example, enhanced retention may be achieved with materials with lower ClogP values—see US 2007/0138673. However, it has now been found that capsules cured at high temperatures do not have an overall desirable release profile, i.e., they lack a linear release profile in damp, pre-rub and post-rub stages of a model fabric conditioner.

Therefore, the present invention features a system composed of a combination of microcapsules that have one or more different characteristics, which result in desirable release profiles and/or stability. In particular, the system of the invention includes a combination of two or more types of microcapsules that differ in properties selected from cure temperatures, curing times, or a combination thereof.

In some embodiments, the system is composed of two, three, four, five, six, seven or more different types of capsules that differ by one or more of the above-referenced characteristics. In particular embodiments, the system is composed of two types of microcapsules, described herein as a first capsule containing an active material and a second capsule containing an active material.

In accordance with some embodiments, the two or more different types of capsules of the system have different wall characteristics, i.e., different wall materials, different amounts of wall materials, and/or different ratios of wall materials. By way of illustration, a first capsule can be composed of melamine-formaldehyde and a second capsule can be composed of urea-formaldehyde so that the first and second capsules have different wall materials. In another illustrative example, a first capsule can be composed of 10% co-polyacrylamide/acrylate and 6% methylated melamine crosslinker and a second capsule can be composed of 5% co-polyacrylamide/acrylate and 3% methylated melamine crosslinker so that the first and second capsules have different amounts of wall materials. As yet another illustrative example, a first capsule can be composed of 5% co-polyacrylamide/acrylate and 5% methylated melamine crosslinker and a second capsule can be composed of 5% co-polyacrylamide/acrylate and 3% methylated melamine crosslinker so that the first and second capsules have different ratios of wall materials.

Encapsulation of active materials such as fragrances is known in the art, see for example U.S. Pat. Nos. 2,800,457, 3,870,542, 3,516,941, 3,415,758, 3,041,288, 5,112,688, 6,329,057, and 6,261,483. Another discussion of fragrance encapsulation is found in the Kirk-Othmer Encyclopedia.

Preferred encapsulating polymers include those formed from melamine-formaldehyde or urea-formaldehyde condensates, or co-polyacrylamide/acrylate with a methylated melamine crosslinker, as well as similar types of aminoplasts. Additionally, microcapsules made via the simple or complex coacervation of gelatin are also preferred for use with a coating. Microcapsules having shell walls composed of polyurethane, polyamide, polyolefin, polysaccharide, protein, silicone, lipid, modified cellulose, gums, polyacrylate, polystyrene, and polyesters or combinations of these materials are also functional.

A representative process used for aminoplast encapsulation is disclosed in U.S. Pat. No. 3,516,941 though it is recognized that many variations with regard to materials and process steps are possible. A representative process used for gelatin encapsulation is disclosed in U.S. Pat. No. 2,800,457 though it is recognized that many variations with regard to materials and process steps are possible. Both of these processes are discussed in the context of fragrance encapsulation for use in consumer products in U.S. Pat. Nos. 4,145,184 and 5,112,688, respectively.

Microcapsule formation using melamine-formaldehyde or urea-formaldehyde pre-condensates in combination with polymers containing substituted vinyl monomeric units having proton-donating functional group moieties (e.g. sulfonic acid groups or carboxylic acid anhydride groups) bonded thereto is disclosed in U.S. Pat. No. 4,406,816 (2-acrylamido-2-methyl-propane sulfonic acid groups), GB 2,062,570 A (styrene sulfonic acid groups) and GB 2,006,709 A (carboxylic acid anhydride groups).

The cross-linkable acrylic acid polymer or co-polymer microcapsule shell wall precursor has a plurality of carboxylic acid moieties and is preferably one or a blend of an acrylic acid polymer; a methacrylic acid polymer; an acrylic acid-methacrylic acid co-polymer; an acrylamide-acrylic acid co-polymer; a methacrylamide-acrylic acid co-polymer; an acrylamide-methacrylic acid co-polymer; a methacrylamide-methacrylic acid co-polymer; a C1-C4 alkyl acrylate-acrylic acid co-polymer; a C1-C4 alkyl acrylate-methacrylic acid co-polymer; a C1-C4 alkyl methacrylate-acrylic acid co-polymer; a C1-C4 alkyl methacrylate-methacrylic acid co-polymer; a C1-C4 alkyl acrylate-acrylic acid-acrylamide co-polymer; a C1-C4 alkyl acrylate-methacrylic acid-acrylamide co-polymer; a C1-C4 alkyl methacrylate-acrylic acid-acrylamide co-polymer; a C1-C4 alkyl methacrylate-methacrylic acid-acrylamide co-polymer; a C1-C4 alkyl acrylate-acrylic acid-methacrylamide co-polymer; a C1-C4 alkyl acrylate-methacrylic acid-methacrylamide co-polymer; a C1-C4 alkyl methacrylate-acrylic acid-methacrylamide co-polymer; and a C1-C4 alkyl methacrylate-methacrylic acid-methacrylamide co-polymer; and more preferably, an acrylic acid-acrylamide copolymer.

When substituted or un-substituted acrylic acid co-polymers are employed in the practice of this invention, in the case of using a co-polymer having two different monomeric units, e.g., acrylamide monomeric units and acrylic acid monomeric units, the mole ratio of the first monomeric unit to the second monomeric unit is in the range of from about 1:9 to about 9:1, preferably from about 3:7 to about 7:3. In the case of using a co-polymer having three different monomeric units, e.g., ethyl methacrylate, acrylic acid and acrylamide, the mole ratio of the first monomeric unit to the second monomeric unit to the third monomeric unit is in the range of 1:1:8 to about 8:8:1, preferably from about 3:3:7 to about 7:7:3.

The molecular weight range of the substituted or un-substituted acrylic acid polymers or co-polymers useful in the practice of this invention is from about 5,000 to about 1,000,000, preferably from about 10,000 to about 100,000. The substituted or un-substituted acrylic acid polymers or co-polymers useful in the practice of this invention may be branched, linear, star-shaped, dendritic-shaped or may be a block polymer or copolymer, or blends of any of the aforementioned polymers or copolymers.

Such substituted or un-substituted acrylic acid polymers or co-polymers may be prepared according to any processes known to those skilled in the art, for example, U.S. Pat. No. 6,545,084.

Urea-formaldehyde and melamine-formaldehyde pre-condensate microcapsule shell wall precursors are prepared by means of reacting urea or melamine with formaldehyde where the mole ratio of melamine or urea to formaldehyde is in the range of from about 10:1 to about 1:6, preferably from about 1:2 to about 1:5. For purposes of practicing the invention, the resulting material has a molecular weight in the range of from 156 to 3000. The resulting material may be used 'as-is' as a cross-linking agent for the aforementioned substituted or un-substituted acrylic acid polymer or copolymer or it may be further reacted with a C1-C6 alkanol, e.g., methanol, ethanol, 2-propanol, 3-propanol, 1-butanol, 1-pentanol or 1-hexanol, thereby forming a partial ether where the mole ratio of melamine or urea:formalhyde:alkanol is in the range of 1:(0.1-6):(0.1-6). The resulting ether moiety-containing product may be used 'as-is' as a cross-linking agent for the aforementioned substituted or un-substituted acrylic acid polymer or copolymer, or it may be self-condensed to form dimers, trimers and/or tetramers which may also be used as cross-linking agents for the aforementioned substituted or un-substituted acrylic acid polymers or co-polymers. Methods for formation of such melamine-formaldehyde and urea-formaldehyde pre-condensates are set forth in U.S. Pat. Nos. 3,516,846, 6,261,483, and Lee, et al. (2002) *J. Microencapsulation* 19:559-569. Examples of urea-formaldehyde pre-condensates useful in the practice of the invention are URAC 180 and URAC 186 (Cytec Technology Corp., Wilmington, Del.). Examples of melamine-formaldehyde pre-condensates useful in the practice of our invention are CYMEL U-60, CYMEL U-64 and CYMEL U-65 (Cytec Technology Corp.). In the practice of this invention it is preferable to use as the precondensate for cross-linking the substituted or un-substituted acrylic acid polymer or co-polymer.

In practicing this invention, the range of mole ratios of urea-formaldehyde precondensate or melamine-formaldehyde pre-condensate:substituted or un-substituted acrylic acid polymer or co-polymer is in the range of from about 9:1 to about 1:9, preferably from about 5:1 to about 1:5 and most preferably from about 2:1 to about 1:2.

In another embodiment, microcapsules with polymer(s) composed of primary and/or secondary amine reactive groups or mixtures thereof and crosslinkers can be used, as disclosed in US 2006/0248665. The amine polymers can possess primary and/or secondary amine functionalities and can be of either natural or synthetic origin. Amine containing polymers of natural origin are typically proteins such as gelatin and albumen, as well as some polysaccharides. Synthetic amine polymers include various degrees of hydrolyzed polyvinyl formamides, polyvinylamines, polyallyl amines and other synthetic polymers with primary and secondary amine pendants. Examples of suitable amine polymers are the LUPAMIN series of polyvinyl formamides (available from BASF). The molecular weights of these materials can range from about 10,000 to about 1,000,000.

The polymers containing primary and/or secondary amines can be used with any of the following comonomers in any combination (i) vinyl and acrylic monomers having alkyl, aryl and silyl substituents; OH, COOH, SH, aldehyde, trimonium, sulfonate, $NH_2$, NHR substituents; or vinyl pyridine, vinyl pyridine-N-oxide, vinyl pyrrolidone; (ii) cationic monomers such as dialkyl dimethylammonium chloride, vinyl imidazolinium halides, methylated vinyl pyridine, cationic acrylamides and guanidine-based monomers; or (iii) N-vinyl formamide and any mixtures thereof. The ratio of amine monomer/total monomer ranges from about 0.01 to about 0.99, more preferred from about 0.1 to about 0.9.

In addition, instead of amine-containing polymers it is possible to utilize amine-generating polymers that can generate primary and secondary amines during the microcapsule formation process as disclosed in US 2006/0248665.

The crosslinkers can include aminoplasts, aldehydes such as formaldehyde and acetaldehyde, dialdehydes such as glutaraldehyde, epoxy, active oxygen such as ozone and OH radicals, poly-substituted carboxylic acids and derivatives such as acid chlorides, anhydrides, isocyanates, diketones, halide-substituted, sulfonyl chloride-based organics, inorganic crosslinkers such as $Ca^{2+}$, organics capable of forming azo, azoxy and hydrazo bonds, lactones and lactams, thionyl chloride, phosgene, tannin/tannic acid, polyphenols and mixtures thereof. Furthermore, processes such as free radical and radiation crosslinking can be used according to the present invention. Examples of free radical crosslinkers are benzoyl peroxide, sodium persulfate, azoisobutylnitrile (AIBN) and mixtures thereof.

With respect to the crosslinker, wall properties are influenced by two factors, the degree of crosslinking and the hydrophobic or hydrophilic nature of the crosslinker. The quantity and reactivity of the crosslinker determine the degree of crosslinking. The degree of crosslinking influences the microcapsule wall permeability by forming a physical barrier towards diffusion. Walls made from crosslinkers possessing low-reactive groups will have smaller degrees of crosslinking than walls made from high-reactive crosslinkers. If a high degree of crosslinking is desired from a low-reactive crosslinker, more is added. If a low degree of crosslinking is desired from a high-reactive crosslinker, then less is added. The nature and quantity of the crosslinker can also influence the hydrophobicity/hydrophilicity of the wall. Some crosslinkers are more hydrophobic than others and these can be used to impart hydrophobic qualities to the wall, with the degree of hydrophobicity directly proportional to the quantity of crosslinker used.

Optimization of the degree of crosslinked network of the microcapsules can be reached by adjusting the amount of crosslinker used in combination with the curing temperatures, e.g., below, at or above 100° C.

The degree of crosslinking and degree of hydrophobicity can result from a single crosslinker or a combination of crosslinkers. A crosslinker that is highly reactive and hydrophobic can be used to create microcapsule walls with a high degree of crosslinking and a hydrophobic nature. Single crosslinkers that possess both these qualities are limited and thus crosslinker blends can be employed to exploit these combinations. Crosslinkers possessing high reactivities but low hydrophobicities can be used in combination with a low reactive, high hydrophobicity crosslinker to yield walls with high degrees of crosslinking and high hydrophobicity. Suitable crosslinkers are disclosed in US 2006/0248665.

The molecular weight range of the substituted or un-substituted amine-containing polymers or co-polymers and mixtures thereof, useful in the practice of this invention is from about 1,000 to about 1,000,000, preferably from about 10,000 to about 500,000. The substituted or un-substituted amine-containing polymers or co-polymers useful in the practice of our invention may be branched, linear, star-shaped, graft, ladder, comb/brush, dendritic-shaped or may be a block polymer or copolymer, or blends of any of the aforementioned polymers or copolymers. Alternatively, these polymers may also possess thermotropic and/or lyotropic liquid crystalline properties.

The diameter of the microcapsules or capsules herein can vary from about 10 nanometers to about 1000 microns, preferably from about 50 nanometers to about 100 microns and most preferably from about 1 to about 15 microns. The microcapsule distribution can be narrow, broad, or multimodal. Each modal of the multi-modal distributions may be composed of different types of microcapsule chemistries.

In accordance with other embodiments, the two or more different types of capsules of the system have the same or different core characteristics, i.e., different core active materials; different core modifiers such as solvents, emulsifiers and surfactants; and/or different scavengers. By way of illustration, a first capsule can contain of a combination of cinnamyl acetate and cinnamyl cinnamate and a second capsule can contain vanilla so that the first and second capsules have different core active materials.

The Active Material

The active materials suitable for use in the present invention are preferably perfumes (also referred to herein as "fragrances"). The perfume is suitable for delivery in a controlled-release manner onto surfaces being treated with the present compositions or into the environment surrounding the surfaces.

The compositions may also comprise an unconfined (also called non-encapsulated) active material. Perfumes described below are suitable for use as the encapsulated active material and also as the unconfined active material.

The total amount of perfume is preferably from 0.01 to 10% by weight, more preferably from 0.05 to 5% by weight, even more preferably from 0.1 to 4.0%, most preferably from 0.15 to 4.0% by weight, based on the total weight of the fabric conditioner composition.

The amount of encapsulated perfume present in the composition is preferably from 0.5 to 80 wt %, more preferably from 5 to 60 wt %, even more preferably from 10 to 50 wt % still more preferably from 15 to 45 wt % and most preferably from 25 to 45 wt % by weight of the total perfume.

The microcapsules containing fragrance provide a controlled-release scent onto the surface being treated or into the environment surrounding the surface. In this case, the fragrance can be composed of a number of fragrance raw materials known in the art, such as essential oils, botanical extracts, synthetic fragrance materials, and the like.

In general, the active material is contained in the microcapsules at a level of from about 1% to about 99%, preferably from about 10% to about 95%, and more preferably from about 30% to about 90%, by weight of the total microcapsules. The weight of the total microcapsule particles includes the weight of the shell of the microcapsule plus the weight of the material inside the microcapsule.

The fragrances suitable for use in this invention include without limitation, any combination of fragrance, essential oil, plant extract or mixture thereof that is compatible with, and capable of being encapsulated by a polymer.

Many types of fragrances can be employed in the present invention, the only limitation being the compatibility and ability to be encapsulated by the polymer being employed, and compatibility with the encapsulation process used. Suitable fragrances include but are not limited to fruits such as almond, apple, cherry, grape, pear, pineapple, orange, strawberry, raspberry; musk, flower scents such as lavender-like, rose-like, iris-like, and carnation-like. Other pleasant scents include herbal scents such as rosemary, thyme, and sage; and woodland scents derived from pine, spruce and other forest smells. Fragrances may also be derived from various oils, such as essential oils, or from plant materials such as peppermint, spearmint and the like. Other familiar and popular smells can also be employed such as baby powder, popcorn, pizza, cotton candy and the like in the present invention.

A list of suitable fragrances is provided in U.S. Pat. Nos. 4,534,891, 5,112,688 and 5,145,842. Another source of suitable fragrances is found in Perfumes Cosmetics and Soaps, Second Edition, edited by W. A. Poucher, 1959. Among the fragrances provided in this treatise are acacia, cassie, chypre, cylamen, fern, gardenia, hawthorn, heliotrope, honeysuckle, hyacinth, jasmine, lilac, lily, magnolia, mimosa, narcissus, freshly-cut hay, orange blossom, orchids, reseda, sweet pea, trefle, tuberose, vanilla, violet, wallflower, and the like.

Furthermore, it is known in the art that the fragrance materials with lower logP or ClogP (these terms will be used interchangeably from this point forward) exhibit higher aqueous solubility. Thus, when these materials are in the core of a microcapsule with a hydrated wall which is placed in an aqueous consumer product, they will have a greater tendency to diffuse into the surfactant-containing base if the shell wall is permeable to the fragrance materials.

As disclosed in U.S. Pat. No. 7,491,687, the logP of many perfume ingredients has been reported, for example, the Ponoma92 database, available from Daylight Chemical Information Systems, Inc. (Daylight CIS, Irvine, Calif.). The values are most conveniently calculated using ClogP program also available from Daylight CIS. The program also lists experimentally determined log P values when available from the Pomona database. The calculated logP (ClogP) is normally determined by the fragment approach (Hansch & Leo (1990) in *Comprehensive Medicinal Chemistry*, Vol. 4, Hansch, et al. Editors, p. 295, Pergamon Press). This approach is based upon the chemical structure of the fragrance ingredient and takes into account the numbers and types of atoms, the atom connectivity and chemical bonding. The ClogP values which are most reliable and widely used estimates for this physiochemical property can be used instead of the experimental LogP values useful in the present invention. Further information regarding ClogP and logP values can be found in U.S. Pat. No. 5,500,138.

The following fragrance ingredients provided in Table 1 are among those suitable for inclusion within the microcapsules of the present invention.

TABLE 1

| PERFUME INGREDIENTS | CLOGP |
|---|---|
| Allyl amyl glycolate | 2.72 |
| Allyl cyclohexane propionate | 3.94 |
| Ambrettolide | 6.26 |
| Iso-amyl acetate | 2.20 |
| Amyl benzoate | 3.42 |
| Amyl cinnamate | 3.77 |
| Amyl cinnamic aldehyde | 4.32 |
| Amyl cinnamic aldehyde dimethyl acetal | 4.03 |
| Iso-amyl salicylate | 4.60 |
| AURANTIOL (Hydroxycitronellal-methylanthranilate) | 4.22 |
| Benzyl salicylate | 4.38 |
| Butyl cyclohexanone | 2.84 |
| Para-tert-Butyl cyclohexyl acetate | 4.02 |
| Iso-butyl quinoline | 4.19 |
| Iso-butyl thiazole | 2.94 |
| Beta-Caryophyllene | 6.33 |
| Cadinene | 7.35 |

TABLE 1-continued

| PERFUME INGREDIENTS | CLOGP |
|---|---|
| Carvone | 2.27 |
| Cedrol | 4.53 |
| Cedryl acetate | 5.44 |
| Cedryl formate | 5.07 |
| Cinnamyl acetate | 2.39 |
| Cinnamyl cinnamate | 5.48 |
| Cyclohexyl salicylate | 5.27 |
| Cyclamen aldehyde | 3.68 |
| Cyclacet | 2.97 |
| Dihydro carvone | 2.41 |
| Diphenyl methane | 4.06 |
| Diphenyl oxide | 4.24 |
| Dodecalactone | 4.36 |
| ISO E SUPER 1-(1,2,3,4,5,6,7,8-Octahydro-2,3,8,8-tetramethyl-2-naphthalenyl)-ethanone) | 3.46 |
| Ethylene brassylate | 4.55 |
| Ethyl-2-methyl butyrate | 2.11 |
| Ethyl amyl ketone | 2.46 |
| Ethyl cinnamate | 2.85 |
| Ethyl undecylenate | 4.89 |
| EXALTOLIDE (15-Hydroxyentadecanloic acid, lactone) | 5.35 |
| GALAXOLIDE (1,3,4,6,7,8-Hexahydro-4,6,6,7,8,8-hexamethylcyclopenta-gamma-2-benzopyran) | 5.48 |
| Geranyl anthranilate | 4.22 |
| Geranyl phenyl acetate | 5.23 |
| Hedione | 2.53 |
| Hexadecanolide | 6.81 |
| Hexenyl salicylate | 4.72 |
| Hexyl cinnamic aldehyde | 4.90 |
| Hexyl salicylate | 4.91 |
| Alpha-Irone | 3.82 |
| Liffarome | 2.23 |
| LILIAL (para-tertiary-butyl-alpha-methyl hydrocinnamic aldehyde Linalyl benzoate | 3.86 |
| Lyral | 5.23 |
| Manzanate | 2.08 |
| Methyl caproate | 2.65 |
| Methyl dihydrojasmone | 2.33 |
| Gamma-n-Methyl ionone | 4.84 |
| Musk indanone | 4.31 |
| Musk tibetine | 5.46 |
| Oxahexadecanolide-10 | 3.83 |
| Oxahexadecanolide-11 | 4.34 |
| Patchouli alcohol | 4.34 |
| PHANTOLIDE (5-Acetyl-1,1,2,3,3,6-hexamethyl indan) | 4.53 |
| Phenyl ethyl benzoate | 5.98 |
| Phenylethylphenylacetate | 4.21 |
| Phenyl heptanol | 3.77 |
| Resetone | 3.48 |
| Alpha-Santalol | 2.59 |
| Styrallyl acetate | 3.80 |
| Thibetolide (15-Hydroxypentadecanoic acid, lactone) | 2.05 |
| Triplal | 6.25 |
| Delta-Undecalactone | 2.34 |
| Gamma-Undecalactone | 3.83 |
| Vetiveryl acetate | 4.14 |
| Ylangene | 4.88 |
| | 6.27 |

In order to provide the highest fragrance impact from the fragrance encapsulated microcapsules deposited on the various substrates referenced above, it is preferred that materials with a high odor-activity be used. Materials with high odor-activity can be detected by sensory receptors at low concentrations in air, thus providing high fragrance perception from low levels of deposited microcapsules. This property must be balanced with the volatility as described above. Some of the principles mentioned above are disclosed in U.S. Pat. No. 5,112,688.

In embodiments pertaining to high temperature cured microcapsules described herein, a wider range of ClogP materials may be employed because of the improved stability of the microcapsules. Accordingly, the core active material may have at least about 60 weight % of materials with ClogP greater than 2.0, preferably greater than about 80 weight % with a ClogP greater than 2.5 and more preferably greater than about 80 weight % of materials with ClogP greater than 3.0. In another embodiment, high stability microcapsules may also allow up to 100% retention of active material with log P equal to and less than 2 to be effectively encapsulated.

In certain embodiments of this invention, the first and second capsules have different amounts of fragrances with particular vapor pressures. In specific embodiments, the first capsule contains a fragrance, wherein 50-100 weight % of the fragrance, more preferably 60-100 weight % of the fragrance and most preferably 70-90 weight % of the fragrance has a saturated vapor pressure at 23° C. of greater than 0.01 mm Hg, and the second capsule contains a fragrance, wherein 20-100 weight % of the fragrance, more preferably 30-80 weight % of the fragrance and most preferably 40-60 weight % of the fragrance has a saturated vapor pressure at 23° C. of greater than or equal to 0.01 mm Hg. In particular, the first capsule contains a fragrance, wherein 50-100 weight % of the fragrance, more preferably 60-100 weight % of the fragrance and most preferably 70-90 weight % of the fragrance has a saturated vapor pressure at 23° C. of greater than 0.01 mm Hg and the capsule is cured at a temperature at or above 100° C. for at least 2 hours, and the second capsule contains a fragrance, wherein 20-100 weight % of the fragrance, more preferably 30-80 weight % of the fragrance and most preferably 40-60 weight % of the fragrance has a saturated vapor pressure at 23° C. of greater than or equal to 0.01 mm Hg and the capsule is cured at a temperature of less than 100° C. for less than 2 hours. The determination of saturated vapor pressure of fragrances can be carried out by conventional methods. See, e.g., Rudolfi et al. (1986) *J. Chromatograph. A* 365:413-415; Friberg & Yin (1999) *J. Disp. Sci. Technol.* 20:395-414.

Those with skill in the art appreciate that fragrance formulations are frequently complex mixtures of many fragrance ingredients. A perfumer commonly has several thousand fragrance chemicals to work from. Those with skill in the art appreciate that the each capsule of the first or second capsule may contain a single ingredient, but it is much more likely that the capsules will include at least eight or more fragrance chemicals, more likely to contain twelve or more and often twenty or more fragrance chemicals. The present invention also contemplates the use of complex fragrance formulations containing fifty or more fragrance chemicals, seventy five or more or even a hundred or more fragrance chemicals in a fragrance formulation.

The level of fragrance in a microcapsule of this invention varies from about 5 to about 95 wt %, preferably from about 40 to about 95 wt % and most preferably from about 50 to about 90 wt %.

Other Materials Used in Conjunction with the Perfume

In addition to the fragrance, other materials may be used in conjunction with the fragrance.

Malodour Counteractants

The present active material may further include one or more malodour counteractants at a level preferably less than about 70 wt %, more preferably less than about 50 wt % of the composition. The malodour counteractant composition serves to reduce or remove malodor from the surfaces or objects being treated with the present compositions. The malodour counteractant composition is preferably selected from uncomplexed cyclodextrin, odor blockers, reactive aldehydes, flavanoids, zeolites, activated carbon, and mixtures thereof. Compositions herein that include odor control agents can be used in methods to reduce or remove malodor from surfaces treated with the compositions.

Specific examples of malodour counteractant composition components useful in the microcapsules herein include, but are not limited to, malodour counteractant components such as 1-cyclohexylethan-1-yl butyrate, 1-cyclohexylethan-1-yl acetate, 1-cyclohexylethan-1-ol, 1-(4'-methylethyl)cyclohexylethan-1-yl propionate, and 2'-hydroxy-1'-ethyl(2-phenoxy)acetate, each of which compound is marketed under the trademark VEILEX by International Flavors & Fragrances Inc. (New York, N.Y.); and malodour counteractant components such as those disclosed in U.S. Pat. No. 6,379,658, which include β-naphthyl methyl ether, β-naphthyl ketone, benzyl acetone, mixture of hexahydro-4,7-methanoinden-5-yl propionate and hexahydro-4,7-methanoinden-6-yl propionate, 4-(2,6,6-trimethyl-2-cyclohexen-1-yl)-3-methyl-3-buten-2-one, 3,7-dimethyl-2,6-nonadien-1-nitrile, dodecahydro-3a,6,6,9a-tetramethyl naphtho(2,1-b)furan, ethylene glycol cyclic ester of n-dodecanedioic acid, 1-cyclohexadecen-6-one; 1-cycloheptadecen-10-one, and corn mint oil.

Solvents

In addition to the fragrance materials, the present invention contemplates the incorporation of solvent materials into one or more of the microcapsules. The solvent materials are hydrophobic materials that are miscible in fragrance materials. The solvent materials serve to increase the compatibility of various active materials, increase the overall hydrophobicity of the blend, influence the vapor pressure of active materials, or serve to structure the blend. Suitable solvents are those having reasonable affinity for the fragrance chemicals and a ClogP greater than 2.5, preferably greater than 3.5 and most preferably greater than 5.5. Suitable solvent materials include, but are not limited to triglyceride oil, mono and diglycerides, mineral oil, silicone oil, diethyl phthalate, polyalpha olefins, castor oil and isopropyl myristate. In a preferred embodiment the solvent materials are combined with fragrance materials that have ClogP values as set forth above. It should be noted that selecting a solvent and fragrance with high affinity for each other will result in the most pronounced improvement in stability. Appropriate solvents include, but are not limited to, mono-, di- and tri-esters, and mixtures thereof, or fatty acids and glycerine, wherein the fatty acid chain can range from C4-C26 and the fatty acid chain can have any level of unsaturation. For instance capric/caprylic triglyceride known as NEOBEE M5 (Stepan Corporation) is a suitable solvent. Other suitable examples are the CAPMUL series by Abitec Corporation. For instance, CAPMUL MCM. Additional solvents include, isopropyl myristate; fatty acid esters of polyglycerol oligomers, e.g., R2CO—[$OCH_2$—CH(OCOR1)-$CH_2O$—]$_n$, where R1 and R2 can be H or C4-26 aliphatic chains, or mixtures thereof, and n ranges between 2-50, preferably 2-30; nonionic fatty alcohol alkoxylates like the NEODOL surfactants by BASF, the Dobanol surfactants by Shell Corporation or the BIO-SOFT surfactants by Stepan, wherein the alkoxy group is ethoxy, propoxy, butoxy, or mixtures thereof and said surfactants can be end-capped with methyl groups in order to increase their hydrophobicity; di- and tri-fatty acid chain containing nonionic, anionic and cationic surfactants, and mixtures thereof; fatty acid esters of polyethylene glycol, polypropylene glycol, and polybutylene glycol, or mixtures thereof; polyalphaolefins such as the EXXONMOBIL PURESYM PAO line; esters such as the EXXONMOBIL PURESYN esters; mineral oil; silicone oils such polydimethyl siloxane and polydimethylcyclosiloxane; diethyl phthalate; di-octyl adipate and di-isodecyl adipate.

While no solvent is needed in the core, it is preferable that the level of solvent in the core of the microcapsule product should be less than about 80 wt %, preferably less than about 50 wt % and most preferably 0 to 20 wt %. In addition to the solvent it is preferred that higher ClogP fragrance materials are employed. It is preferred that greater than about 25 wt %, preferably greater than 50 wt % and more preferably greater than about 90 wt % of the fragrance chemicals have ClogP values between 2.0, and about 7.0, preferably between 2.0 and about 6.0 and most preferably between 2.0 and 5.0. Those with skill in the art will appreciate that many formulations can be created employing various solvents and fragrance chemicals. The use of relatively low to intermediate ClogP fragrance chemicals will result in a fragrance that can be encapsulated, provided it is sufficiently water-insoluble, deliver ingredients onto critical consumer stages such as damp and dry fabric that would normally have evaporated or dissolved in water during the wash. Whilst high log P materials have excellent encapsulation properties they are generally well delivered from a regular (non-encapsulated) fragrance in a consumer product. Such fragrance chemicals would generally only need encapsulation for overall fragrance character purposes, very long-lasting fragrance delivery, or overcoming incompatibility with the consumer product, e.g., fragrance materials that would otherwise be instable, cause thickening or discoloration of the product or otherwise negatively affect desired consumer product properties.

Formaldehyde Scavengers

A common feature of many encapsulation processes is that they require the fragrance material to be encapsulated to be dispersed in aqueous solutions of polymers, pre-condensates, surfactants, scavengers and the like prior to formation of the microcapsule walls. In one embodiment, the capsules of the system of this invention have different scavengers, in particular formaldehyde scavengers. According to this embodiment, the formaldehyde scavenger can be used from effective trace amounts up to 100 times the stoichiometric amount. The stoichiometric amount is the amount of scavenger required to theoretically bind or react all the formaldehyde added in the form of an aminoplast crosslinker (bound and free formaldehyde). This amount of scavenger can be added either to the slurry or afterward to the final product formulation. For instance, an unscavenged slurry can be added to the formulation, followed by a certain amount of scavenger.

The particular quantity of a formaldehyde-based crosslinker that is used to create the capsule slurry contains a percentage of free formaldehyde and bound formaldehyde. The total combined moles of free and bound formaldehyde will determine the amount of moles of scavenger that is needed to react with all the formaldehyde. To drive this reaction to completion, about a 10× molar excess of scavenger is used, preferably about a 5× molar excess of scavenger. By moles here is meant moles of scavenging groups. Therefore, if the scavenger molecule is multifunctional (i.e., polymeric) less moles of this molecule needs to be added. This is the maximum level of scavenger needed based on the amount of crosslinker used.

The minimum level of scavenger required is that amount that scavenges only the free formaldehyde in the slurry. This level is determined analytically. The minimum amount of moles of scavenger required is equal to the moles of measured formaldehyde (1:1). Exemplary formaldehyde scavengers include β-dicarbonyl compounds; mono or di-amide scavengers; amines that form imines by reaction with formaldehyde; and formaldehyde reducers and sulfur containing compounds, such as those disclosed in US 2009/0258042.

The β-dicarbonyl compounds of the present invention have an acidic hydrogen giving rise to a nucleophilic atom that can react with formaldehyde. Specific examples of β-dicarbonyl compounds include, but are not limited to, acetoacetamide (BKB; Eastman), ethyl acetoacetate (EAA; Eastman), N,N-dimethyleneacetamide (DMAA; Eastman), acetoacetone, dimethyl-1,3-acetonedicarboxylate, 1,3-acetonedicarboxylic acid, malonic acid, resorcinol, 1,3-cyclohexadione, barbituric acid, 5,5-dimethyl-1,3-cyclohexanedione (dimedone), 2,2-dimethyl-1,3-dioxane-4,6-dione (Meldrum's acid), salicylic acid, methyl acetoacetate (MAA; Eastman), ethyl-2-methyl acetoacetate, 3-methylacetoacetone, dimethyl malonate, diethyl malonate, 1,3-dimethyl barbituric acid, resorcinol, phloroglucinol, orcinol, 2,4-dihydroxy benzoic acid, 3,5-dihydroxy benzoic acid, malonamide and β-dicarbonyl scavengers listed in U.S. Pat. Nos. 5,194,674 and 5,446,195, as well as in Tomasino, et al. (1984) Textile Chemist and Colorist Vol. 16, No. 12.

Examples of the preferred effective mono- and di-amide scavengers are urea, ethylene urea, propylene urea, epsilon-caprolactam, glycouril, hydantoin, 2-oxazolidinone, 2-pyrrolidinone, uracil, barbituric acid, thymine, uric acid, allantoin, polyamides, 4,5-dihydroxyethylene urea, monomethylol-4-hydroxy-4-methoxy-5,5-dimethyl propylurea, nylon 2-hydroxyethyl ethylene urea (SR-511, SR-512; Sartomer), 2-hydroxyethyl urea (HYDROVANCE; National Starch), L-citrulline, biotin, N-methyl urea, N-ethyl urea, N-butyl urea, N-phenyl urea, 4,5-dimethoxy ethylene urea and succinimide.

Amines contemplated by this invention include, but are not limited to, poly(vinyl amine) (LUPAMIN; BASF), arginine, lysine, asparagines, proline, tryptophan, 2-amino-2-methyl-1-propanol (AMP); proteins such as casein, gelatin, collagen, whey protein, soy protein, and albumin; melamine, benzoguanamine, 4-aminobenzoic acid (PABA), 3-aminobenzoic acid, 2-aminobenzoic acid (anthranilic acid), 2-aminophenol, 3-aminophenol, 4-aminophenol, creatine, 4-aminosalicylic acid, 5-aminosalicylic acid, methyl anthranilate, methoxylamine HCl, anthranilamide, 4-aminobenzamide, p-toluidine, p-anisidine, sulfanilic acid, sulfanilamide, methyl-4-aminobenzoate, ethyl-4-aminobenzoate (benzocain), beta-diethylaminoethyl-4-aminobenzoate (procain), 4-aminobenzamide, 3,5-diaminobenzoic acid and 2,4-diaminophenol. Other amines as disclosed in US 2006/0248665 and U.S. Pat. No. 6,261,483, and those mentioned in Tomasino, et al. (1984) *Textile Chemist and Colorist* Vol. 16, No. 12, are also contemplated by the present invention. Hydrazines such as 2,4-dinitrophenzylhydrazine can also react with formaldehyde by the first method to give hydrazones. The reaction is pH-dependent and reversible. Other preferred amines can be selected from a non-limiting list of 1,2-phenylenediamine, 1,3-phenylenediamine, and 1,4-phenylenediamine. In addition, aromatic amines, triamines, and aliphatic polyamine may also be used. Examples of these amines may include, but are not limited to, aniline, hexamethylenediamine, bis-hexamethylenetriamine, triethylaminetriamine, poly(propyleneoxide)triamine, and poly(propyleneglycol)diamines.

Optional Core Modifiers

According to one embodiment of the invention, optional core modifiers may be added to the capsule slurry. For example, a non-confined unencapsulated active material from 0.01 wt % to 50 wt %, more preferably from about 5 wt % to 40 wt % can be included.

Deposition Aid

A capsule deposition aid (i.e., cationic starches such as Hi-CAT CWS42, cationic guars such as Jaguar C-162, cationic amino resins, cationic urea resins, hydrophobic quaternary amines, etc.) from 0.01 wt % to 25 wt %, more preferably from 5 wt % to 20 wt % can be included.

Emulsifier

Optionally, an emulsifier (i.e., nonionic such as polyoxyethylene sorbitan monostearate (TWEEN 60), anionic such as sodium oleate, zwitterionic such as lecithins) from 0.01 wt % to 25 wt %, more preferably from 5 wt % to 10 wt % can be included.

Humectants and Viscosity Control Agents

Optionally, humectant (i.e., polyhydric alcohols such as glycerin, propylene glycol, maltitol, alkoxylated nonionic polymers such as polyethylene glycols, polypropylene glycols, etc.) from 0.01 wt % to 25 wt %, more preferably from 1 wt % to 5 wt % can be included.

Viscosity control agents (suspending agents), which may be polymeric or colloidal (i.e., modified cellulose polymers such as methylcellulose, hydoxyethylcellulose, hydrophobically modified hydroxyethylcellulose, cross-linked acrylate polymers such as Carbomer, hydrophobically modified polyethers, etc.) from 0.01 wt % to 25 wt %, more preferably from 0.5 wt % to 10 wt % can be included. Optionally, silicas which may be hydrophobic (i.e., silanol surface treated with halogen silanes, alkoxysilanes, silazanes, siloxanes, etc. such as SIPERNAT D17, AEROSIL R972 and R974 (available from Degussa), etc.) and/or hydrophilic such as AEROSIL 200, SIPERNAT 22S, SIPERNAT 50S, (available from Degussa), SYLOID 244 (available from Grace Davison), etc. from 0.01 wt % to 20 wt %, more preferably from 0.5 wt % to 5 wt % can be included.

Further suitable humectants and viscosity control/suspending agents are disclosed in U.S. Pat. Nos. 4,428,869, 4,464,271, 4,446,032, and 6,930,078. Details of hydrophobic silicas as a functional delivery vehicle of active materials other than a free flow/anticaking agent are disclosed in U.S. Pat. Nos. 5,500,223 and 6,608,017.

Curing Parameters

In accordance with other embodiments, the two or more different types of capsules of the system have been cured in a different manner, i.e., different cure temperatures, different heating rates and/or different curing times. By way of illustration, a first capsule can be cured at a temperature of 125° C. and a second capsule can be cured at 85° C. so that the first and second capsules have been cured at different temperatures. In another illustrative example, a first capsule can be cured for 2 hours and a second capsule can be cured for 4 hours so that the first and second capsules have been cured for different times.

According to one embodiment of the invention, there is a direct relationship between higher cure temperature and less leaching of active material from the microcapsule. In accordance with this embodiment, the retention capabilities of a microcapsule are improved when the crosslinked network of polymers containing active materials are cured at temperatures at or above 100° C. In a more preferred embodiment, the retention capabilities of a microcapsule are improved when the cure temperature is above 110° C. In a most preferred embodiment, the retention capabilities of a microcapsule are improved when the cure temperature is above 120° C.

To obtain a microcapsule with more leaching of the active material from the microcapsule, certain embodiments of this invention provide for a cure temperature of less than 100° C. In some embodiments, the cure temperature of a microcapsule is at or less than 90° C. In other embodiments, the cure temperature of a microcapsule is at or less than 80° C.

In particular embodiments, a first capsule is cured at a temperature at or above 100° C. and a second capsule is cured at a temperature below 100° C. In other embodiments, a first capsule is cured at a temperature above 120° C. and a second capsule is cured at a temperature of between 80 and 99° C.

Furthermore, higher performance of the microcapsules can be achieved by curing at a higher temperature for a longer time. Therefore, in some embodiments, the crosslinked network of polymers containing active materials may be cured for periods of up to 1 hour and preferably longer than two hours. More preferably, the curing period of the capsule is at least up to 2 hours, at least up to 3 hours, or at least up to 4 hours. In particular embodiments, a first capsule is cured between 1 and 4 hours and a second capsule is cured between 1 and 4 hours. In certain embodiments, both the first and second capsule are cured for 2 hours at different temperatures.

In a more preferred embodiment, greater performance of the microcapsules can be achieved when the heating profile to the target cure temperature of the crosslinked network of polymers containing the active material is preferably linear with a heating rate at least up to 2.0° C. per minute, more preferably at least up to 5.0° C. per minute, even more preferably at least up to 8.0° C. per minute and most preferably at least up to 10° C. per minute over a period of time less than sixty minutes and more preferably less than thirty minutes. The following heating methods may be used in the practice of the present invention: conduction, for example via oil, steam radiation via infrared, and microwave; convection via heated air, steam injection, and other methods known by those skilled in the art.

In the present invention, the target cure temperature is the minimum temperature in degrees Celsius at which the capsule comprising crosslinked network of polymers containing active materials may be cured for a period of minimal time period to retard leaching. The time period at the target cure temperature needed to retard leaching can be from at least up to two minutes to at least up to 1 hour before the capsules are cooled. More preferably, the curing period of the capsule is up to 2 hours, up to 3 hours, or up to 4 hours.

In a preferred embodiment, the combination of two or more types of microcapsules retain greater than 40 wt % of the encapsulated active material after a four week period in a fabric conditioner product, e.g. containing surfactants, alcohols, or volatile silicones that can leach active materials from capsules over time. In a more preferred embodiment, the microcapsules retain greater than 50 wt % of the encapsulated active material after a four week period. In a most preferred embodiment, the microcapsules retain greater than 60 wt % of the encapsulated active material. Retention capabilities may vary dependent on the formulation of the fabric conditioner base, such as the level of surfactant which may range, for example, from 8 wt % to 50 wt % as well as the nature of the encapsulated active material and storage temperature.

Leaching of active material, such as fragrance, occurs not only when stored in the fabric conditioner products of the invention, but also when using the fabric softener product during the rinse cycle of a laundry process. The microcapsules of the present invention also exhibit enhanced stability during the wash and rinse cycles.

The term high stability refers to the ability of a microcapsule product to retain active materials in bases that have a tendency to promote leaching of the active material out of the microcapsule product into the base. As used herein stability of the products is measured at room temperature or above over a period of at least a week. More preferably the capsules of the present invention are allowed to be stored at 37° C. for more than about two weeks and preferably more than about four weeks. More particularly, a capsule is preferably stored for 8 weeks at 37° C., which represent a 6 to 12 month shelf-life of a fabric conditioner product.

The composition generally contains greater than 10 wt % water, more preferably greater than 30 wt % water and most preferably greater than 50 wt % water. The microcapsules used in the invention may have been spray dried using the process described in US 2007/0078071.

Well known materials such as solvents, surfactants, emulsifiers, and the like can be used in addition to the polymers described throughout the invention to encapsulate the active materials such as fragrance without departing from the scope of the present invention. It is understood that the term encapsulated is meant to mean that the active material is substantially covered in its entirety. Encapsulation can provide pore vacancies or interstitial openings depending on the encapsulation techniques employed. More preferably the entire active material portion of the present invention is encapsulated.

According to the invention, the combination of two or more types of microcapsules described herein is incorporated into fabric conditioner products. There are tremendous benefits for using the disclosed combination including providing high stability microcapsules, a longer shelf life, more stability during transportation and importantly superior sensory performance over time, e.g., a linear release profile.

It is believed that there exists a relationship between higher concentration of surfactants in the base of consumer products and an increased leaching effect of the encapsulated active materials out of the microcapsules and into the base. Bases that are primarily non-aqueous in nature, e.g., those that are based on alcohols, or volatile silicones can also leach active materials from capsules over time. Volatile silicones such as but not limited to cyclomethicone and are exemplified by SF1256 CYCLOPENTASILOXANE and SF1257 CYCLOPENTASILOXANE (General Electric Company).

According to the present invention, the system is well suited for a variety of applications, including wash-off products. In some embodiments, the system provides a first capsule and a second capsule at a ratio of 2:1. In other embodiments, the system provides a first capsule and a second capsule at a ratio of 1:2. In particular embodiments, the system provides a first capsule and a second capsule at a ratio of 1:1.

As described herein, the present system is well suited for use in fabric softeners. These products employ surfactant and emulsifying systems that are well known. For example, fabric softener systems are described in U.S. Pat. Nos. 6,335,315, 5,674,832, 5,759,990, 5,877,145, 5,574,179; 5,562,849, 5,545,350, 5,545,340, 5,411,671, 5,403,499, 5,288,417, and 4,767,547, 4,424,134.

The Fabric Softening Compound

The composition is a fabric conditioner. The fabric conditioner comprises a fabric softening active.

Suitable fabric softening compounds are described below.

The fabric conditioning agents (also referred to herein as a fabric softening active or compound) may be cationic or non-ionic.

Fabric conditioning compositions for use in accordance with the invention are concentrated and will contain at least 8 wt %, preferably from about 8 to 30 wt %, more preferably from 8 to 25 wt %, even more preferably from 9 to 20 wt % of softening active.

The preferred softening active for use in rinse conditioner compositions of the invention is a quaternary ammonium compound (QAC). The preferred quaternary ammonium fabric conditioner for use in compositions of the present invention are the so called "ester quats".

Particularly preferred materials are the ester-linked triethanolamine (TEA) quaternary ammonium compounds comprising a mixture of mono-, di- and tri-ester linked components.

Typically, TEA-based fabric softening compounds comprise a mixture of mono, di- and tri-ester forms of the compound where the di-ester linked component comprises no more than 70 wt % of the fabric softening compound, preferably no more than 60 wt % of the fabric softening compound and at least 10 wt % of the monoester linked component.

A first group of quaternary ammonium compounds (QACs) suitable for use in the present invention is represented by formula (I):

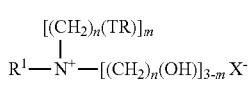

(I)

wherein each R is independently selected from a $C_{5-35}$ alkyl or alkenyl group; $R^1$ represents a $C_{1-4}$ alkyl, $C_{2-4}$ alkenyl or a $C_{1-4}$ hydroxyalkyl group; T may be either O—CO. (i.e. an ester group bound to R via its carbon atom), or may alternatively be CO—O (i.e. an ester group bound to R via its oxygen atom); n is a number selected from 1 to 4; m is a number selected from 1, 2, or 3; and $X^-$ is an anionic counter-ion, such as a halide or alkyl sulphate, e.g. chloride or methylsulfate. Di-esters variants of formula I (i.e. m=2) are preferred and typically have mono- and tri-ester analogues associated with them. Such materials are particularly suitable for use in the present invention.

Suitable actives include soft quaternary ammonium actives such as Stepantex VK90, Stepantex VT90, Stepantex KF90 SP88-2 (ex-Stepan), Prapagen TQN (ex-Clariant), Dehyquart AU-57 (ex-Cognis), Rewoquat WE18 (ex-Degussa) and Tetranyl L1/90N, Tetranyl L190 SP and Tetranyl L190 S (all ex-Kao).

Also suitable are actives rich in the di-esters of triethanolammonium methylsulfate, otherwise referred to as "TEA ester quats".

Commercial examples include Stepantex™ UL85, ex Stepan, Prapagen™ TQL, ex Clariant, and Tetranyl™ AHT-1, ex Kao, (both di-[hardened tallow ester] of triethanolammonium methylsulfate), AT-1 (di-[tallow ester] of triethanolammonium methylsulfate), and L5/90 (di-[palm ester] of triethanolammonium methylsulfate), both ex Kao, and Rewoquat™ WE15 (a di-ester of triethanolammonium methylsulfate having fatty acyl residues deriving from $C_{10}$-$C_{20}$ and $C_{16}$-$C_{18}$ unsaturated fatty acids), ex Witco Corporation.

A second group of QACs suitable for use in the invention is represented by formula (II):

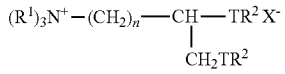

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; and wherein n, T, and $X^-$ are as defined above.

Preferred materials of this second group include 1,2 bis[tallowoyloxy]-3-trimethylammonium propane chloride, 1,2 bis[hardened tallowoyloxy]-3-trimethylammonium propane chloride, 1,2-bis[oleoyloxy]-3-trimethylammonium propane chloride, and 1,2 bis[stearoyloxy]-3-trimethylammonium propane chloride. Such materials are described in U.S. Pat. No. 4,137,180 (Lever Brothers). Preferably, these materials also comprise an amount of the corresponding mono-ester.

A third group of QACs suitable for use in the invention is represented by formula (III):

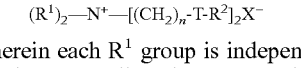

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and n, T, and $X^-$ are as defined above. Preferred materials of this third group include bis(2-tallowoyloxyethyl)dimethyl ammonium chloride, partially hardened and hardened versions thereof.

The iodine value of the quaternary ammonium fabric conditioning material is preferably from 0 to 80, more preferably from 0 to 60, and most preferably from 0 to 45. The iodine value may be chosen as appropriate. Essentially saturated material having an iodine value of from 0 to 5, preferably from 0 to 1 may be used in the compositions of the invention. Such materials are known as "hardened" quaternary ammonium compounds.

A further preferred range of iodine values is from 20 to 60, preferably 25 to 50, more preferably from 30 to 45. A material of this type is a "soft" triethanolamine quaternary ammonium compound, preferably triethanolamine di-alkylester methylsulfate. Such ester-linked triethanolamine quaternary ammonium compounds comprise unsaturated fatty chains.

Iodine value as used in the context of the present invention refers to, the fatty acid used to produce the QAC, the measurement of the degree of unsaturation present in a material by a method of nmr spectroscopy as described in Anal. Chem., 34, 1136 (1962) Johnson and Shoolery.

A further type of softening compound may be a non-ester quaternary ammonium material represented by formula (IV):—

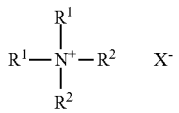

(IV)

wherein each $R^1$ group is independently selected from $C_{1-4}$ alkyl, hydroxyalkyl or $C_{2-4}$ alkenyl groups; $R^2$ group is independently selected from $C_{8-28}$ alkyl or alkenyl groups, and $X^-$ is as defined above.

Oily Sugar Derivatives

The compositions for use in the invention may contain a non-cationic softening material, which is preferably an oily sugar derivative. An oily sugar derivative is a liquid or soft solid derivative of a cyclic polyol (CPE) or of a reduced saccharide (RSE), said derivative resulting from 35 to 100% of the hydroxyl groups in said polyol or in said saccharide being esterified or etherified. The derivative has two or more ester or ether groups independently attached to a $C_8$-$C_{22}$ alkyl or alkenyl chain.

Advantageously, the CPE or RSE does not have any substantial crystalline character at 20° C. Instead it is preferably in a liquid or soft solid state as herein defined at 20° C.

The liquid or soft solid (as hereinafter defined) CPEs or RSEs suitable for use in the present invention result from 35 to 100% of the hydroxyl groups of the starting cyclic polyol or reduced saccharide being esterified or etherified with groups such that the CPEs or RSEs are in the required liquid or soft solid state. These groups typically contain unsaturation, branching or mixed chain lengths.

Typically the CPEs or RSEs have 3 or more ester or ether groups or mixtures thereof, for example 3 to 8, especially 3 to 5. It is preferred if two or more of the ester or ether groups of the CPE or RSE are independently of one another attached to a $C_8$ to $C_{22}$ alkyl or alkenyl chain. The $C_8$ to $C_{22}$ alkyl or alkenyl groups may be branched or linear carbon chains.

Preferably 35 to 85% of the hydroxyl groups, most preferably 40-80%, even more preferably 45-75%, such as 45-70% are esterified or etherified.

Preferably the CPE or RSE contains at least 35% tri or higher esters, e.g. at least 40%.

The CPE or RSE may have at least one of the chains independently attached to the ester or ether groups having at least one unsaturated bond. This provides a cost effective way of making the CPE or RSE a liquid or a soft solid. It is preferred if predominantly unsaturated fatty chains, derived from, for example, rape oil, cotton seed oil, soybean oil, oleic, tallow, palmitoleic, linoleic, erucic or other sources of unsaturated vegetable fatty acids, are attached to the ester/ether groups.

These chains are referred to below as the ester or ether chains (of the CPE or RSE).

The ester or ether chains of the CPE or RSE are preferably predominantly unsaturated. Preferred CPEs or RSEs include sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose tiroleate, glucose tetraoleate, xylose trioleate, or sucrose tetra-, tri-, penta- or hexa-esters with any mixture of predominantly unsaturated fatty acid chains. The most preferred CPEs or RSEs are those with monounsaturated fatty acid chains, i.e. where any polyunsaturation has been removed by partial hydrogenation. However some CPEs or RSEs based on polyunsaturated fatty acid chains, e.g. sucrose tetralinoleate, may be used provided most of the polyunsaturation has been removed by partial hydrogenation.

The most highly preferred liquid CPEs or RSEs are any of the above but where the polyunsaturation has been removed through partial hydrogenation.

Preferably 40% or more of the fatty acid chains contain an unsaturated bond, more preferably 50% or more, most preferably 60% or more. In most cases 65% to 100%, e.g. 65% to 95% contain an unsaturated bond.

CPEs are preferred for use with the present invention. Inositol is a preferred cyclic polyol. Inositol derivatives are especially preferred.

In the context of the present invention, the term cyclic polyol encompasses all forms of saccharides. Indeed saccharides are especially preferred for use with this invention. Monosaccharides and disaccharides are preferred saccharides for the CPEs or RSEs to be derived from.

Examples of monosaccharides include xylose, arabinose, galactose, fructose, sorbose and glucose. Glucose is especially preferred. Examples of disaccharides include maltose, lactose, cellobiose and sucrose. Sucrose is especially preferred. An example of a reduced saccharide is sorbitan.

The liquid or soft solid CPEs can be prepared by methods well known to those skilled in the art. These include acylation of the cyclic polyol or reduced saccharide with an acid chloride; trans-esterification of the cyclic polyol or reduced saccharide fatty acid esters using a variety of catalysts; acylation of the cyclic polyol or reduced saccharide with an acid anhydride and acylation of the cyclic polyol or reduced saccharide with a fatty acid. See for instance U.S. Pat. No. 4,386,213 and AU 14416/88 (both P&G).

The CPE or RSE may have 3 or more, preferably 4 or more ester or ether groups. If the CPE is a disaccharide it is preferred if the disaccharide has 3 or more ester or ether groups. Particularly preferred CPEs are esters with a degree of esterification of 3 to 5, for example, sucrose tri, tetra and penta esters.

Where the cyclic polyol is a reducing sugar it may be advantageous if each ring of the CPE has one ether or ester group, preferably at the $C_1$ position. Suitable examples of such compounds include methyl glucose derivatives.

Examples of suitable CPEs include esters of alkyl(poly) glucosides, in particular alkyl glucoside esters having a degree of polymerisation of 2.

The length of the unsaturated (and saturated if present) chains in the CPE or RSE is $C_8$-$C_{22}$, preferably $C_{12}$-$C_{22}$. It may be possible to include one or more chains of $C_1$-$C_8$, however these are less preferred.

The liquid or soft solid CPEs or RSEs which may be suitable for use in the present invention are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100. The $T_2$ NMR relaxation time is commonly used for characterising solid:liquid ratios in soft solid products such as fats and margarines. For the purpose of the present invention, any component of the signal with a $T_2$ of less than 100 μs is considered to be a solid component and any component with $T_2 \leq 100$ μs is considered to be a liquid component.

For the CPEs and RSEs, the prefixes (e.g. tetra and penta) only indicate the average degrees of esterification. The compounds exist as a mixture of materials ranging from the monoester to the fully esterified ester. It is the average degree of esterification which is used herein to define the CPEs and RSEs.

The HLB of the CPE or RSE is typically between 1 and 3.

Where present, the CPE or RSE is preferably present in the composition in an amount of 0.5-50% by weight, based upon the total weight of the composition, more preferably 1-30% by weight, such as 2-25%, e.g. 2-20%.

The CPEs and RSEs for use in the compositions of the invention include sucrose tetraoleate, sucrose pentaerucate, sucrose tetraerucate and sucrose pentaoleate.

Co-softeners and Fatty Complexing Agents

Co-softeners may be used. When employed, they are typically present at from 0.1 to 20 wt % and particularly at from 0.3 to 10 wt %, based on the total weight of the composition. Preferred co-softeners include fatty esters, and fatty N-oxides. Fatty esters that may be employed include fatty monoesters, such as glycerol monostearate, fatty sugar esters, such as those disclosed WO 01/46361 (Unilever).

The compositions for use in the present invention may comprise a fatty complexing agent.

Especially suitable fatty complexing agents include fatty alcohols and fatty acids. Of these, fatty alcohols are most preferred.

Fatty complexing material may be used to improve the viscosity profile of the composition.

Preferred fatty acids include hardened tallow fatty acid (available under the tradename Pristerene™, ex Uniqema). Preferred fatty alcohols include hardened tallow alcohol (available under the tradenames Stenol™ and Hydrenol™, ex Cognis and Laurex™ CS, ex Albright and Wilson).

The fatty complexing agent may be present in an amount greater than 0.3 to 5 wt % based on the total weight of the composition. The fatty component may be present in an amount of from 0.4 to 4 wt %. The weight ratio of the mono-ester component of the quaternary ammonium fabric softening material to the fatty complexing agent may be from 5:1 to 1:5, preferably 4:1 to 1:4, most preferably 3:1 to 1:3, e.g. 2:1 to 1:2.

Non-ionic Surfactant

The compositions of the present invention may further comprise a nonionic surfactant. Typically these can be included for the purpose of stabilising the compositions. These are particularly suitable for compositions comprising hardened quaternary ammonium compounds.

Suitable nonionic surfactants include addition products of ethylene oxide with fatty alcohols, fatty acids and fatty amines. Any of the alkoxylated materials of the particular type described hereinafter can be used as the nonionic surfactant.

Suitable surfactants are substantially water soluble surfactants of the general formula:

$$R—Y—(C_2H_4O)_z—CH_2—CH_2—OH$$

where R is selected from the group consisting of primary, secondary and branched chain alkyl and/or acyl hydrocarbyl groups (when Y=—C(O)O, R≠an acyl hydrocarbyl group); primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16. Genapol™ C200 (Clariant) based on coco chain and 20 EO groups is an example of a suitable nonionic surfactant.

If present, the nonionic surfactant is present in an amount from 0.01 to 10 wt %, more preferably 0.1 to 5 wt %, based on the total weight of the composition.

Further Optional Ingredients

The compositions for use in the invention may contain one or more other ingredients. Such ingredients include further preservatives (e.g. bactericides), pH buffering agents, perfume carriers, hydrotropes, anti-redeposition agents, soil-release agents, polyelectrolytes, anti-shrinking agents, anti-wrinkle agents, anti-oxidants, sunscreens, anti-corrosion agents, drape imparting agents, anti-static agents, ironing aids, silicones, antifoams, colorants, shading dyes, pearlisers and/or opacifiers, natural oils/extracts, processing aids, e.g. electrolytes, hygiene agents, e.g. anti-bacterials and antifungals, thickeners and skin benefit agents.

The fabric softening compositions may also comprise viscosity modifiers. Suitable viscosity modifiers are disclosed, for example, in WO 02/081611, US 2004/0214736, U.S. Pat. No. 6,827,795, EP 0501714, US 2003/0104964, EP 0385749 EP 331237 and EP2373774.

Product Form

The compositions for use in the present invention are preferably rinse-added softening compositions.

The compositions have a pH ranging from 1.8 to 6, preferably from 2.0 to 4.5, most preferably about 2.1 to 2.8. The compositions for use in the invention may contain pH modifiers such as hydrochloric acid or lactic acid.

A composition of the invention is preferably in liquid form. The composition may be a concentrate to be diluted in a solvent, including water, before use. The composition may also be a ready-to-use (in-use) composition. The composition may be provided as a ready to use liquid comprising an aqueous phase. The aqueous phase may comprise water-soluble species, such as mineral salts or short chain ($C_{1-4}$) alcohols.

The composition is preferably for use in the rinse cycle of a home textile laundering operation, where, it may be added directly in an undiluted state to a washing machine, e.g. through a dispenser drawer or, for a top-loading washing machine, directly into the drum. Alternatively, it can be diluted prior to use. The compositions may also be used in a domestic hand-washing laundry operation. It is also possible for the compositions of the present invention to be used in industrial laundry operations, e.g. as a finishing agent for softening new clothes prior to sale to consumers.

Preparation

Compositions used in the invention can be prepared by any method suitable for preparing dispersed, emulsified systems.

One method involves the forming of a molten premixture of the active materials which is added to water at an elevated temperature. Additional water may be added to obtain the desired active concentration. The premixture is then cooled to ambient temperature. When desired, some minor ingredients such as electrolytes, colouring agents, etc may be post-dosed or added to the water at an appropriate part of the preparation. A second method involves the forming of the product by phase inversion of a water in hydrocarbon emulsion, wherein the cationic material is either part of the hydrocarbon phase or added as a separate predispersion. The encapsulated perfume may be post dosed, for example in the form of an aqueous slurry, or as a diluted slurry; or may be added to the aqueous phase before combination with the melt.

EXAMPLES

Embodiments of the invention will now be illustrated by the following non-limiting examples. Further modifications will be apparent to the person skilled in the art.

Examples of the invention are represented by a number. Comparative examples are represented by a letter.

Unless otherwise stated, amounts of components are expressed as a percentage of the total weight of the composition.

Example 1

Preparation of Type 1 and Type 2 Microcapsules

The following procedure was used to prepare microcapsules as used in these examples:—

Fragrance was admixed with NEOBEE-M5 and 40% ethylene urea solution thereby forming a fragrance/solvent composition. The uncoated capsules were prepared by creating a polymeric wall to encapsulate the fragrance/solvent composition droplets. To make the capsule slurry, a copolyacrylamide/acrylate (ALCAPSOL 200) was dispersed in water together with a high imino methylated melamine crosslinker (CYMEL 385, Cytec Industries, Belgium). The capsule components were allowed to react under acidic conditions. The fragrance/solvent composition was then added into the solution and droplets of the desired size were achieved by high shear homogenization.

Composition of the resulting microcapsules is shown in Table 2 below.

TABLE 2

Composition of core and wall of microcapsules prepared as described above.

| Component | Weight % |
|---|---|
| Core | |
| Fragrance | 28 |
| NEOBEE-M5 | 7 |
| 40% Ethylene Urea Solution | 5.7 |
| Wall | |
| ALCAPSOL 200 | 5.7 |
| 3.1% CYMEL 385 | 3.1 |

In this way, two different types of capsules were produced, Type 1 and Type 2, which differed in the fragrance composition (as shown in Table 3) and also the curing temperature: Type 1 was cured for 1 hour at 125° C. and Type 2 was cured for 1 hour at 80° C. Capsules prepared as described above are summarized in Table 1.

TABLE 3

Composition of fragrance used to prepare Type 1 and Type 2 microcapsules.

| Microcapsule | Fragrance Commercial name | Oil with High saturated vapour pressure at 23° C. (>0.01 mm Hg) [wt %] | Oil with Low Saturated vapour pressure at 23° C. (<0.01 mm Hg) [wt %] |
|---|---|---|---|
| Type 1 | Jillz* | 81% | 18% |
| Type 2 | Greenfields* | 53% | 46% |

*Fragrance commercially available from International Flavors & Fragrances Inc.

Type 1 and Type 2 microcapsules had different curing times and different perfume component oils.

Example 2

Preparation of Fabric Softener Compositions 1-3 Containing Type 1 and Type 2 Microcapsules, and Comparative Compositions A and B, Containing Only a Single Microcapsule In this example, an unfragranced model fabric conditioner composition containing approximately 20% cationic quaternary surfactants was used as a base. Both Type 1 and Type 2 microcapsules having shell walls composed of an acrylamide-acrylic acid co-polymer cross linked with melamine-formaldehyde resin, as described in Example 1, were mixed with the model fabric conditioner separately using an overhead agitator at 300 rpm until homogeneous. In this way, 5 fabric conditioner compositions, designated herein Fabric Conditioners 1-3 and A and B, were prepared. The compositions of the five Fabric Conditioners are listed in Table 4.

TABLE 4

Composition of Fabric Conditioners 1-3, A and B, containing Type 1 and/or Type 2 microcapsules.

| Sample | Type 1 Microcapsule (wt % by wt perfume in the encap) | Type 2 Microcapsule (wt % by wt perfume in the encap) |
|---|---|---|
| A | 0 | 0.9 |
| 1 | 0.3 | 0.6 |
| 2 | 0.45 | 0.45 |
| 3 | 0.6 | 0.3 |
| B | 0.9 | 0 |

The fabric softener samples were stored at 5° C. or 37° C. for 4, 6 and 8 weeks.

Example 3

Sensory Performance of Fabric Conditioners 1-3, A and B

The sensory performance of each Fabric Conditioner was tested using the following methodology:—

Fabric conditioners 1-3, A and B (20 grams per sample) were introduced into a Miele Professional PW6055 Plus front loader washing machine during the rinse cycle thereof to condition eight hand towels, in total weighing approximately 2200 gm including bulk load. After rinsing, the damp towels were evaluated by a sensory panel of 16 people using the Label Magnitude Scale (LMS) from 0 to 99, wherein 3="barely detectable", 7="weak", 16="moderate" and 32="strong". Sensory scores were recorded. A set of eight towels from a second wash were lined dried for 24 hours followed by sensory evaluation of the eight towels. The eight selected dry towels were thus evaluated by a panel of 16 people using the LMS.

Sensory scores were recorded before and after each of the eight randomly selected towels contained in a separate polyethylene bag was rubbed by hand. Each rubbing test including rubbing the towels five times, 2 seconds per time interval, for a total rubbing time of 10 seconds. The absolute intensity scores obtained from the sensory panel are presented in Table 5.

TABLE 5

Fragrance intensity scores on fabrics treated with Fabric Conditioners 1-3, A and B, at damp, pre-rub and post-rub stages, following storage at 5° C. for 4 weeks, and 37° C. for 4 and 8 weeks.

| | 5° C. (4 weeks) | | | 37° C. (4 weeks) | | | 37° C. (8 weeks) | | |
|---|---|---|---|---|---|---|---|---|---|
| Sample | Damp | Pre-Rub (dry) | Post-Rub (dry) | Damp | Pre-Rub (dry) | Post-Rub (dry) | Damp | Pre-Rub (dry) | Post-Rub (dry) |
| A | 15.4 | 13.7 | 17.0 | 16.8 | 9.7 | 10.2 | 16.7 | 8.1 | 7.9 |
| 1 | 14.4 | 13.2 | 20.1 | 15.5 | 9.7 | 15.5 | 15.8 | 8.2 | 8.8 |
| 2 | 15.8 | 13.5 | 20.3 | 12.4 | 10.6 | 16.5 | 14.8 | 8.8 | 13.3 |
| 3 | 13.9 | 12.5 | 20.6 | 13.4 | 10.3 | 18.5 | 13.7 | 8.9 | 15.3 |
| B | 12.9 | 8.4 | 25.3 | 14.5 | 13.9 | 22.7 | 19.0 | 9.2 | 18.7 |

The ideal capsule would have a linear release profile across the three stages (damp, pre-rub and post-rub), thus providing a more constant fragrance benefit to consumers.

After 4 weeks at 5° C., control fabric conditioner A, containing only Type 2 microcapsules, gave the highest score on damp and dry pre-rub. However, after storage at 37° C., the pre-rub and post-rub scores have dropped off significantly.

Control B, containing only Type 1 capsules gave the highest fragrance scores on post-rub, but poor scores on pre-rub, resulting in poor release linearity across the three stages.

Fabric conditioners 1-3, in accordance with the invention, comprising a mixture of Type 1 and Type 2 capsules, gave good scores at damp and post-rub stages and far superior linearity across all three stages, particularly on aging under extended storage conditions.

Example 4

Preparation of Fabric Conditioners 4 & 5 in Accordance with the Invention, and Comparative Examples C & D A fabric conditioner, commercially available under the brand name Comfort Blue Skies (containing free oil & microcapsule fragrances) was designated comparative example C.

A second fabric conditioner, commercially available under the brand name Lenor Ruby Jasmine (containing free oil & microcapsule fragrances) was designated comparative example D.

Two fabric conditioners, in accordance with the invention, containing free oil, Type 1 and Type 2 fragrance microcapsules were prepared as described below. These were designated Fabric Conditioners 4 and 5.

Compositions 4 and 5 were made by adding a melt comprising the fabric softening active (TEAQ) to a heated (about 40-60° C.) aqueous phase comprising the minors, perfume capsules, acid and antifoam. A proportion of $CaCl_2$ was added to the water before the addition of the melt to the water, and the remaining $CaCl_2$ was added after the addition of the melt. Free oil perfume was then added upon cooling.

TABLE 6

Compositions of Fabric Conditioners 4 & 5

| | Amount (wt % by wt perfume in the encap) | |
|---|---|---|
| Ingredient | Composition 4 | Composition 5 |
| TEAQ[1] | 20 | 20 |
| Antifoam[2] | 0.02 | 0.02 |
| Hydrochloric acid | 0.03 | 0.03 |
| $CaCl_2$ | 0.21 | 0.21 |
| Perfume V | 1.04 | — |
| Perfume W | — | 1.31 |
| [5]Capsule Type 2, perfume Z | 0.35 | 0.325 |
| [4]Capsule Type 1, perfume X | 0.35 | — |
| [4]Capsule Type 1, perfume Y | — | 0.325 |
| water & minors[3] | balance | balance |

[1]Softening active - Palm based soft TEA Quat; ex Stepan
[2]Comprising silicone; Ex Basildon
[3]Preservative, sequestrant
[4]Capsule Type 1 = cured for 1 hr at 125° C.
[5]Capsule Type 2 = cured for 1 hr at 80° C.

Example 5

Sensory Performance of Fabric Conditioners 4 & 5 in Accordance with the Invention, and Comparative Examples C & D The sensory performance of Fabric Conditioners 4 & 5 in accordance with the invention, and Comparative Examples C & D was evaluated by consumers in an in-homes test, at various stages during the laundry process. The test involved 90 consumers per product over a 2 week period.

The performance was measured with a post use questionnaire, which asked the following question:—

"What do you think about the strength of the perfume at the following stages of the laundry process? When smelling from the bottle; when taking wet laundry out of the washing machine; in the air when drying; while ironing the laundry; on dry items while in storage; and when wearing clothes for the first time after washing."

Answer: much too weak/little too weak/just about right/little too strong/much too strong.

The results of this analysis are presented in Table 7.

TABLE 7

Percentage of consumers assessing fragrance strength as "just about right" on laundry treated with Composition 4 and Comparative Composition C.

| Stage of Laundry Process | Percentage of consumers assessing fragrance strength as "Just about right" | | | |
|---|---|---|---|---|
| | C | 4 | D | 5 |
| When smelling from the bottle | 78 | 83 | 80 | 83 |
| When taking wet laundry out of the washing machine | 83 | 92 | 84 | 86 |
| In the air when drying | 81 | 93 | 78 | 82 |
| While ironing the laundry | 80 | 88 | 72 | 80 |
| On dry items while in storage | 76 | 88 | 70 | 79 |
| When wearing clothes for the first time after washing | 77 | 90 | 71 | 81 |

It will be seen that Composition 4 delivers a lower total amount of perfume oil (free oil+encapsulated) per recommended dose, compared to C, yet delivers better "just about right" scores at all stages.

Similarly, Composition 5 delivers a lower total amount of perfume oil (free oil+encapsulated) per recommended dose, compared to D, yet delivers better "just about right" scores at all stages.

Example 6

Technical Performance of Fabric Conditioners 4 and C

The technical performance of Fabric Conditioners 4 and C was measured at various stages during the laundry process in an in-homes test with trained panelists. The 34 panelists evaluated each of the 2 products in 3 washes, using a measured dose of product with their normal laundry, scoring perfume intensity at key stages after washing. Fragrance intensity was scored on a 0 ("no fragrance") to 100 ("very strong fragrance") scale.

TABLE 8

Perfume intensity score on laundry treated with Composition 4 and Comparative Composition C at various stages of the laundry process.

| Assessment point | Perfume intensity score (0 to 100) | |
|---|---|---|
| | Comfort Blue Skies (C) (35 ml) | Model composition 4 (20 ml) |
| Taking laundry from machine | 27.6 | 35.6 |
| Bundle of wet laundry | 30.3 | 38.1 |
| Hanging on maiden | 28.0 | 34.8 |
| Bloom in room | 43.0 | 49.5 |

Composition 4 delivers a lower total amount of perfume oil (free oil+encapsulated) per recommended dose, yet delivers superior perfume intensity at a previously weak assessment point to give a more linear release profile.

The invention claimed is:

1. A fabric conditioning composition comprising:

(a) at least 8 wt % of a fabric conditioning active;

(b) a first capsule containing an active material, wherein the first capsule comprises a cured polymeric wall and a core; and (c) a second capsule containing an active material wherein the second capsule comprises a cured polymeric wall and a core;

wherein the first and second capsules differ in release properties due to their polymer walls having been made using the same polymer and different cure temperatures, curing times, or a combination thereof; and wherein the composition provides a controlled-release of the active material.

2. A fabric conditioning composition as claimed in claim 1, wherein the active materials of the first and second capsules are the same.

3. A fabric conditioning composition as claimed in claim 1, wherein the active materials of the first and second capsules are different.

4. A fabric conditioning composition as claimed in claim 1 wherein the active material of at least the first or second capsule is a fragrance.

5. A fabric conditioning composition as claimed in claim 1 wherein the first capsule is cured at a temperature above 120° C.

6. A fabric conditioning composition as claimed in claim 1 wherein the second capsule is cured at a temperature above 80° C.

7. A fabric conditioning composition as claimed in claim 1 wherein the first capsule is cured for 2 to 4 hours.

8. A fabric conditioning composition as claimed in claim 1 wherein the second capsule is cured for 1 to 2 hours.

9. A fabric conditioning composition as claimed in claim 1 wherein the first capsule and second capsule are present in a 1:1 ratio.

10. A fabric conditioning composition as claimed in claim 1 wherein the active materials of the first or second capsules comprise a malodor counteractant.

11. A fabric conditioning composition as claimed in claim 1 further comprising a third capsule, a fourth capsule, a fifth capsule, a sixth capsule or a seventh capsule.

12. A fabric conditioning composition as claimed in claim 1 wherein the fabric conditioning active is an ester-linked quaternary ammonium active compound.

13. A method for treating fabric comprising contacting the fabric with an aqueous dispersion comprising the composition defined in claim 1 during a laundry process.

14. A fabric conditioning composition as claimed in claim 1 wherein the controlled-release is a linear release.

* * * * *